US011319759B1

(12) United States Patent
Mahendran et al.

(10) Patent No.: US 11,319,759 B1
(45) Date of Patent: May 3, 2022

(54) PHASE TRANSFORMATION MATERIAL DELIVERY AND DEPLOYMENT CHASSIS FOR OPENHOLE ISOLATION

(71) Applicant: Halliburton Energy Services, Inc., Houston, TX (US)

(72) Inventors: Mathusan Mahendran, Rio de Janeiro (BR); Luis Fernando Lemus Torres, Rio de Janeiro (BR); Desiderio Naegele Rodrigues, Jr., Macae (BR)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/138,228

(22) Filed: Dec. 30, 2020

(51) Int. Cl.
*E21B 17/10* (2006.01)
*E21B 33/124* (2006.01)
*E21B 33/14* (2006.01)

(52) U.S. Cl.
CPC ..... *E21B 17/1014* (2013.01); *E21B 17/1021* (2013.01); *E21B 33/124* (2013.01); *E21B 33/146* (2013.01)

(58) Field of Classification Search
CPC .. E21B 33/124; E21B 33/146; E21B 33/1208; E21B 36/008; E21B 17/1014; E21B 17/1021; E21B 17/1078
See application file for complete search history.

(56) References Cited

U.S. PATENT DOCUMENTS 7,934,552 B2 * 5/2011 La Rovere ..... E21B 36/00 166/277
2006/0144591 A1 * 7/2006 Gonzalez ..... E21B 33/13 166/277
2010/0155056 A1 6/2010 Kunz
2012/0255742 A1 * 10/2012 Cortez ..... B23K 23/00 166/378

(Continued)

FOREIGN PATENT DOCUMENTS

EP 1866518 3/2017
WO 2019-151870 8/2019

OTHER PUBLICATIONS

International Search Report and Written Opinion for Application No. PCT/US2021/012499, dated Sep. 24, 2021.

(Continued)

*Primary Examiner* — Christopher J Sebesta
(74) *Attorney, Agent, or Firm* — Scott Richardson; C. Tumey Law Group PLLC

(57) ABSTRACT

An openhole interval of a well may be sealed by deploying a liquified phase transformation material to the openhole interval and allowing it to harden. In at least one example, this may be performed in a single step of building and maintaining pressure. The pressure may rupture a membrane, to introduce a fluid into a chamber with a reactive material (e.g. powder) in a delivery chassis, whereupon the fluid may exothermically combine with the reactive material to liquify the solid phase transformation material. The same (Continued)

applied pressure may also deliver the liquified phase transformation material to a deployment chassis, which then distributes the liquified phase transformation material under pressure to the openhole interval of the well. Various delivery chassis, deployment chassis, and related compositions and methods are disclosed as well.

19 Claims, 6 Drawing Sheets

(56) References Cited

U.S. PATENT DOCUMENTS

| | | | | |
|---|---|---|---|---|
| 2015/0267501 | A1* | 9/2015 | Al-Gouhi | E21B 33/138 166/299 |
| 2018/0148991 | A1* | 5/2018 | Hearn | E21B 29/10 |
| 2019/0085659 | A1 | 3/2019 | Carragher et al. | |
| 2020/0332620 | A1* | 10/2020 | Carragher | E21B 36/003 |

OTHER PUBLICATIONS

BiSN Bismuth Alloy Plugging Devices, Available at https://www.bisn.com/. Accessed Dec. 17, 2020.
Halliburton, San Control, Completion Tools Darcy Endurance Hydraulic Screen®, H012437, Jan. 2017.
Halliburton, Cementing Wellock Resin, H011331, Sep. 2014.

* cited by examiner

PHASE TRANSFORMATION MATERIAL DELIVERY AND DEPLOYMENT CHASSIS FOR OPENHOLE ISOLATION

BACKGROUND

Wells are drilled into subterranean formations to retrieve hydrocarbons such as oil and gas. After drilling a well, at least portions of a well may be lined with a tubular casing to reinforce the wellbore. Casing may be perforated in selected locations to produce hydrocarbon fluids from the formation. Other portions of the well may also be left uncased, which may be referred to as open-hole formations or intervals. The openhole interval is typically not a clean, uniform, or even concentric environment, as compared with a casing of a cased interval.

To help control the flow of fluids downhole, such as drilling fluids, stimulation treatments, and hydrocarbon fluids produced from the well, it is often necessary to seal between tubular tool components and/or between those components and the well. In many instances, for example, it is desirable to divide a subterranean formation into zones and to isolate those zones from one another in order to prevent crossflow of fluids from the rock formation and other areas into the annulus. It may also be desirable to control sand across multi-zone applications.

A packer is an example of a tool having one or more annular sealing elements that may be lowered into a well on a circular mandrel and expanded into sealing engagement with an open-hole wellbore or casing. A packer may be used for any of a variety of situations requiring a seal, such as to isolate zones to be gravel packed and produced separately. A packer may be used to seal between a completion string and wellbore casing, and in other cases may be used to seal directly against an open-hole formation. Due to the relatively raw condition of an open-hole interval as compared with the smooth inner surface of casing, it can be more challenging to create a reliable pack-off in the open-hole interval of a well.

BRIEF DESCRIPTION OF THE DRAWINGS

These drawings illustrate certain aspects of some of the embodiments of the present disclosure and should not be used to limit or define the method.

DETAILED DESCRIPTION

Figure 1:
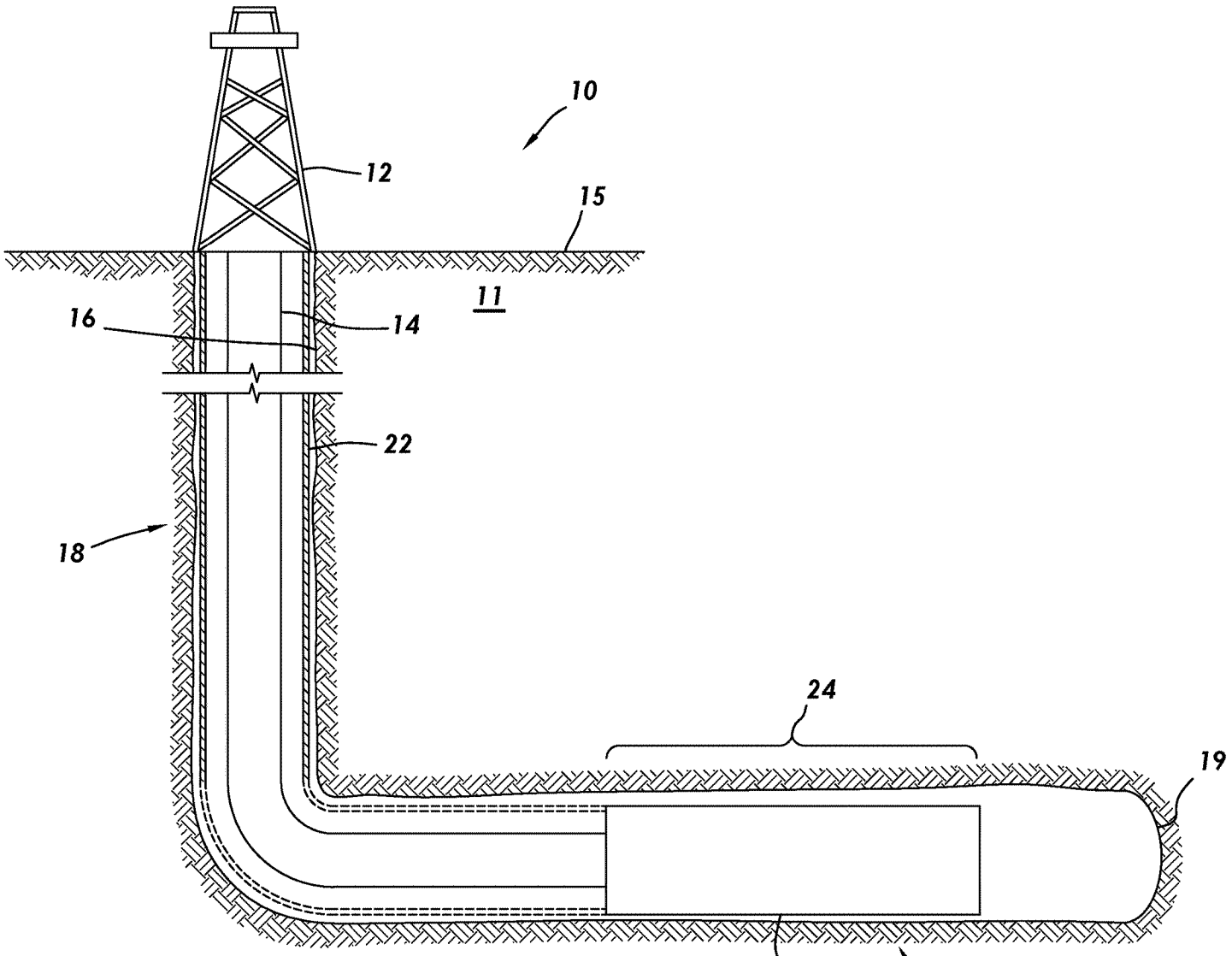
FIG. 1 is a schematic, elevation view (not to scale) of a well site for recovery of hydrocarbons from an underground formation.

Disclosed herein are systems, methods, compositions, and tools for sealing an openhole interval of a wellbore, addressing the challenge of creating a reliable packoff in the openhole interval of a well for zonal isolation. One aspect is to deploy a phase transformation material into the open hole interval in a liquid state and allow the phase transformation material to harden over specific conditions (e.g., temperature, time, phase transformation) in order to create a reliable seal between zones. Use of a liquid-deployed seal that hardens, rather than conventional packing elements which have a fixed run-in-hole ("RIH") geometry and "packet set" geometry, allows the disclosed sealing system to adapt to the specific borehole geometry and porosity of the well. Use of a liquid deployed seal also allows an operator to achieve significantly high expansion ratios for the packer, without sacrificing differential pressure at the maximum borehole inner diameter (max borehole ID), simply by increasing the length of the liquid-deployed seal container for more volume. With lower setting pressures, users do not need to purchase higher rated equipment to take the required pressures, which becomes particularly sensitive in deepwater applications and sour gas applications that typically demand more expensive alloys. Additionally, lower setting pressures lessen the chance of compromising the integrity of the borehole. Rapid deployment over other solutions can be optimized based on the chosen phase transformation material and creating the appropriate conditions for the seal to harden quickly.

In another aspect, a sealing system (e.g. packer) may be activated "on-demand," when the correct depth is reached, regardless of well conditions. The system may be activated in essentially a single step of building and maintaining pressure. The pressure may be used to initiate heating through combination of a fluid with a reactive material such as a magnesium-iron alloy powder. That same pressure may continue to be applied to then urge liquified phase transformation material out of a delivery chassis and to a deployment chassis used to fill an annular volume between the deployment chassis and the openhole interval. An expandable slip jacket comprising a perforated sleeve may also be expanded using inflatable shunts to help fill the annular volume and reinforce the phase transformation material once it hardens.

Any of a variety of phase transformation materials may be used. In the examples that follow, the phase transformation material comprises a eutectic alloy. Generally, the chosen phase transformation material may desirably have significantly low melting points, e.g., between 200° C. to 300° C. (392° F. to 572° F.). The desired melting point may be controlled or adjusted by changing the combination of metals used to create the alloy. In some of the examples that follow, a phase transformation material with a higher melting point may be used at one or both ends, for example. A phase transformation material may be selected with a melting temperature high enough to solidify at a downhole temperature, but low enough to be liquified (melted) without generating excessive heat. The selected phase transformation material may also be heavier than and immiscible with water, to readily displace brine when deployed. Low viscosity may also be desirable, as with water, allowing the phase transformation material to seep readily into micro-channels/pores of the wellbore without requiring large pumping pressure to do so. The selected phase transformation material may also harden immediately once below the melting point, without an intermediate gel phase, significantly reducing set time for the annular seal. The selected phase transformation material may also be chemically inert, allowing use in sour applications. The selected phase transformation material preferably expands when undergoing a phase change from liquid to solid, allowing better adhesion/contact stress to create a seal.

In other examples, the eutectic alloy could be substituted with other phase transformation materials such as polymer resins activated by temperature or by a catalyst. The deployment system can be configured (e.g. a separate container as part of the tubing string) to also control the entry of another chemical that participates in that reaction to allow the liquid phase transformation material seal to be deployed. Other suitable chemicals may include those used apart from the teaching of this disclosure for containing water or gas leaks, which are activated by an accelerator chemical to speed up the time of setting. Still other phase transformation material materials may comprise ultra-low melting point glass, which have relatively fast setting times, and may be chemically inert enough to create a long term seal.

The example heating reaction used below is the combination of liquid water as the fluid with magnesium alloy powder as the reactive material. However, any exothermic chemical reaction may be used that may be initiated by combining a given fluid with a given reactive material. In the non-limiting examples that follow, the reaction to melt the eutectic alloy, or any phase transformation material that is activated by heat, may be by using a controlled amount of magnesium-iron alloy in combination with water. This reaction may be facilitated by a dissolved salt, which may be prevalent in a downhole environment. By themselves, magnesium and water react with each at slow rates at room temperatures. However, when in powder form, with a small quantity of iron added, and leveraging on the fact that brine (saline) is in the well to be used as an electrolyte, the magnesium and iron particles become electrodes analogous to having numerous tiny, short-circuited batteries, which cause significant heat to be generated. The heat generated is two-fold: first, from the short-circuiting battery concept, and second, from the magnesium and water reaction to form magnesium hydroxide, which is a very exothermic reaction. The heat created produces no flame or red-hot metal, which is safer for downhole applications than higher-temperature reactions that do produce flames and/or red-hot metal.

More particularly, the reactive powder may include a chemical compound known as a scavenger that can minimize the yield of molecular hydrogen released for the reactive powder during heat production process. Hydrogen is deleterious to the mechanical properties of metals and alloys from the chassis, tubing, casing, the phase transformation material, etc. The hydrogen scavenger may therefore be added to absorb and combine the solvated electrons released by the reactive powder, blocking the formation mechanism of molecular hydrogen. Non-limiting examples of hydrogen scavengers include copper (II) chloride, sodium monochloroacetate, sodium trichloroacetate, sodium nitrate, and sodium peroxodisulate.

FIG. 1 is a schematic, elevation view (not to scale) of a well site 10 for recovery of hydrocarbons from an underground formation 11. Although a land-based well site 10 is depicted in FIG. 1, aspects of this disclosure may also be used in offshore and other well sites. A wellbore 16 drilled in the formation 11 includes, by way of example, a vertical section 18 and at least one lateral section 20. Some of the wellbore 16 is lined with casing 22 cemented in place to reinforce the wellbore 16. In this example, the casing 22 is shown at least in the vertical section 18 but the casing may be extended (as indicated by dashed lines) or additional segments of casing 22 may be installed also in the lateral section 20. Other portions of the wellbore 16 may be openhole, i.e., not lined with casing. A large support structure generally indicated at 12 supports a tubing string 14 extending from a surface 15 of the well site 10 down toward a toe 19 of a wellbore 16 drilled in the formation 11. The support structure 12 may include, for example, a derrick, a lifting mechanism such as a hoist or crane, and other equipment. The tubing string 14 may include, for example, a completion string used in completing the well, a production tubing string used to control production of formation fluids, and/or a work string for servicing the well. A system or tool 30 for sealing an openhole interval 24 of the well is supported on the end of the tubing string 16. The tubing string may be raised or lowered to position the system 30 anywhere it is desired to close off an openhole interval 24, such as in separating zones and/or isolating a portion of the wellbore 16 for stimulation or production. In this example, the tool 30 is deployed in the lateral section 20 of the wellbore 16 but could alternatively be deployed anywhere along the wellbore 16.

Figure 2:
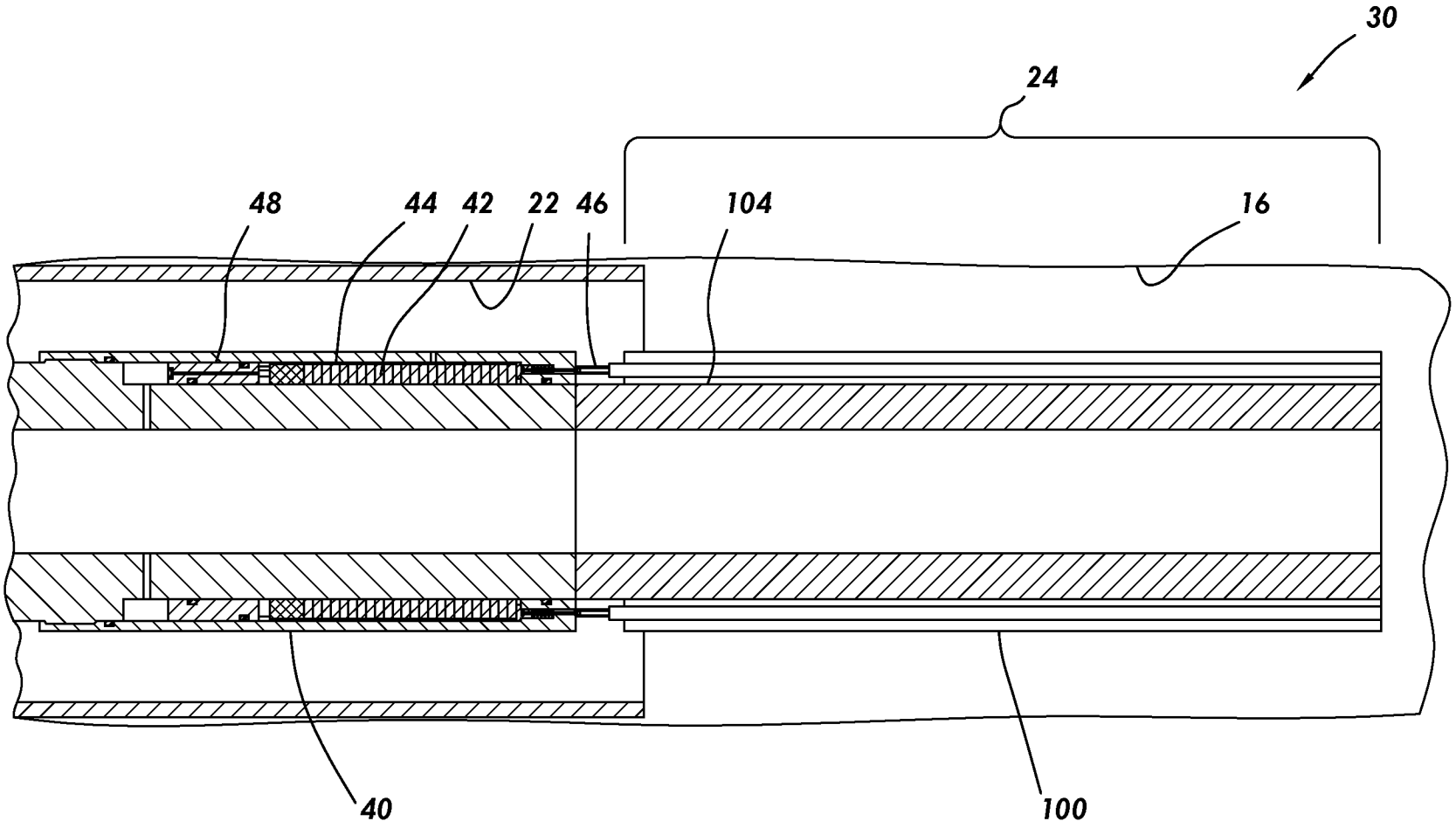
FIG. 2 is a side view of the system according to an example configuration, positioned within the openhole interval of the wellbore to be sealed.

FIG. 2 is a side view of the system 30 according to an example configuration, positioned within the openhole interval 24 of the wellbore 16 to be sealed. The system 30 includes a delivery chassis 40 for liquifying a solid phase transformation material (PTM) 42 and delivering the liquified phase transformation material to a deployment chassis 100. The system 30 includes a central portion generally referred to as a mandrel 104, which may extend along at least a portion of the delivery chassis 40 and deployment chassis 100 for supporting components of these chassis on the mandrel 104. The deployment chassis 100 then distributes the liquified phase transformation material along its length and deploys it to the openhole interval 24. As drawn in FIG. 2, the casing 22 may extend up to, but stops somewhere short of, the openhole interval 24 to be sealed. At least the deployment chassis 100 of the system 30 is axially positioned within the openhole interval 24. As further detailed below, the delivery chassis 40 may liquify the phase transformation material 42 by exothermically combining a reactive material with a fluid within an annular chamber 44, to heat the solid phase transformation material 42 above its melting point. This reaction may be initiated by using pressure to burst a membrane and introduce water into the chamber 44. The pressure may continue to be applied, optionally using a piston 48, to urge the liquified phase transformation material 42 out through one or more circumferentially spaced nozzles 46 of the delivery chassis 40 to the deployment chassis 100.

Figure 3:
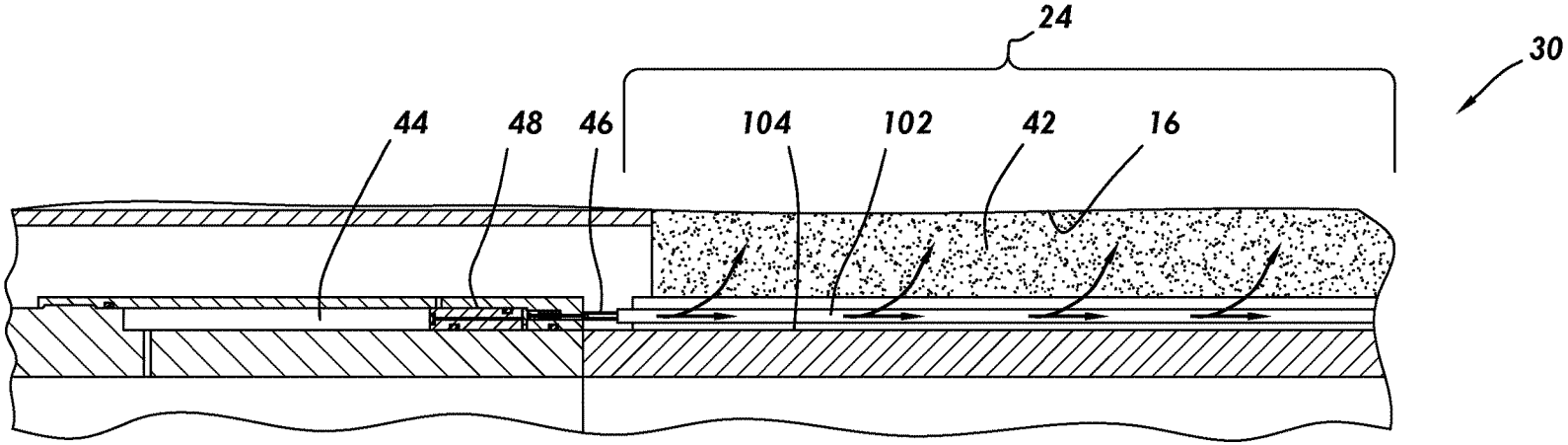
FIG. 3 is a side view of the system of FIG. 2 after the phase transformation material has been liquified and distributed to seal the openhole portion of the formation.

FIG. 3 is a side view of the system 30 of FIG. 2 after the phase transformation material 42 has been liquified and distributed to seal the openhole portion 24 of the formation. The phase transformation material 42 that was initially in the delivery chassis 40 was liquified through exothermic reaction with a liquid and reactive material (as further described herein). The piston 48 was displaced axially along the annular chamber 44 to discharge the liquified phase transformation material out of the nozzles 46 to the delivery chassis 100. The liquified phase transformation material flowed out of the nozzles 46 of the delivery chassis 40 and along the conduits 102 in the deployment chassis 100. The phase transformation material flowed radially outwardly from the conduits 102 to fill the annular volume defined between a mandrel 104 and the openhole portion 24 of the wellbore 16. The liquified phase transformation material 42 was then allowed to harden over specific conditions (e.g., temperature, time) to create a reliable seal between zones of the formation.

Figure 4:
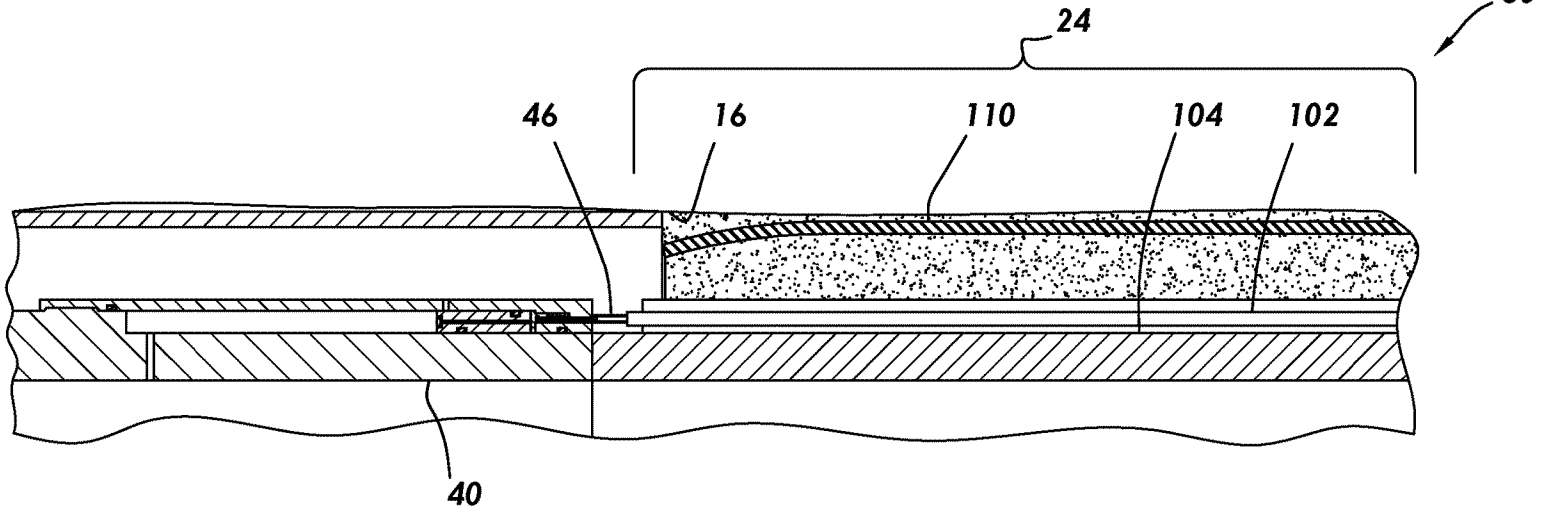
FIG. 4 is a side view of the system including a slip jacket optionally included with the deployment chassis.

FIG. 4 is a side view of the system 30 including a slip jacket 110 optionally included with the deployment chassis 100. Aspects of the slip jacket 110 are discussed in further detail below in connection with subsequent figures. Generally, the slip jacket 110 comprises an expandable, perforated sleeve. The perforated sleeve of the slip jacket 110 is radially expanded toward the openhole interval 24 prior to solidification of the liquified phase transformation material. As in FIG. 3, the liquified phase transformation material exiting the nozzles 46 flowed along the conduits 102 of the deployment chassis 100, except that the liquified phase transformation material also flows outwardly through perforations in the slip jacket 110 to fill the annular volume defined between the mandrel 104 and the openhole portion 24 of the wellbore 16. This annular volume may include an inner volume between the mandrel 104 and the slip jacket 110 and an outer volume between the slip jacket 110 and wellbore 16, as well as the volume of the perforations themselves through which the liquified phase transformation material has flowed and solidified. The slip jacket thus serves multiple purposes. In one aspect, the slip jacket 110 may anchor the tool or system 30 to the wellbore 16 to withstand the axial loads that might be generated due to contraction and expansion of tubing string caused by thermal of pressure variations effects between fixed points. The slip jacket accommodates such movement by preventing the set annular seal from being stroked in the openhole interval due to those axial loads. The slip jacket 110 may also fill some of the annular volume between the mandrel 104 and the borehole 16, to reduce the amount of phase transformation material required to seal. The perforated sleeve allows phase transformation material to flow through the slip jacket 110, so the slip jacket 110 also provides reinforcement akin to "rebar" (e.g., steel-reinforced concrete) for the phase transformation material. The perforations also facilitate radial expansion of the slip jacket 110. The slip jacket 110 and its expansion is further detailed below in FIGS. 7-9.

Figure 5:
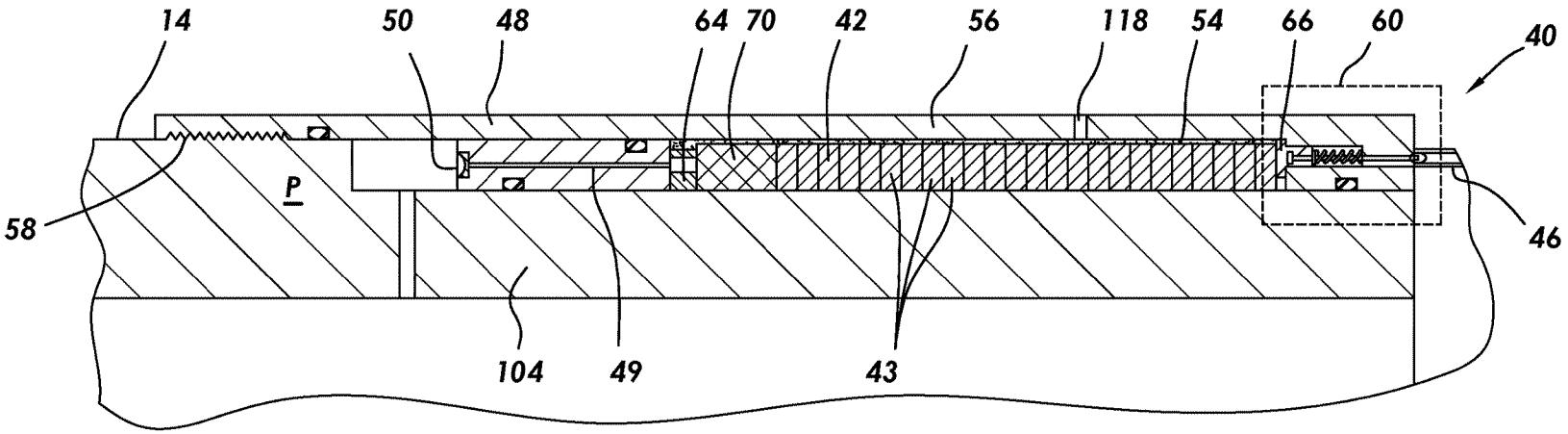
FIG. 5 is an enlarged view of the delivery chassis further detailing a specific example configuration thereof.

FIG. 5 is an enlarged view of the delivery chassis 40 further detailing a specific example configuration thereof. The delivery chassis 40 includes the mandrel 104, a heater casing 56, the annular chamber 44 defined between the mandrel 104 and the heater casing 56, the squeeze piston 48 initially positioned at one end of the annular chamber 44, and a connection 58 (optionally, a threaded connection) for releasably connecting the delivery chassis 40 (and the system 30 generally) to the tubing string 14, such as work string or deployment string extending from surface of the well site (FIG. 1). The phase transformation material 42 is disposed in the annular chamber 44 along with a reactive powder 54. The phase transformation material may comprise a eutectic alloy. The phase transformation material in this configuration comprises a "core" of phase transformation material, cast in solid state into multiple concentric rings 43 to increase surface area and reduce melting time. The reactive powder 54 in this example may comprises a magnesium-iron alloy powder. The reactive powder 54 is distributed along the phase transformation material rings 43 in the same annular chamber 44, so that when it combines with a certain fluid (e.g., water in this example), the exothermic reaction that ensues will uniformly heat the phase transformation material rings 43.

Two additional components, referred to generally as phase transformation material retainers, are included to prevent urging liquified phase transformation material out of the delivery chassis 40 until the core of the phase transformation material has liquified. These phase transformation material retainers in the annular chamber 44 include a standoff ring 64 adjacent the piston 48 and a holding button 66 at a nozzle end 60 of the delivery chassis 40. Each phase transformation material retainer generally functions to prevent the urging of any liquified phase transformation material out the nozzle(s) 46 until the core of the phase transformation material (the phase transformation material rings 43 in this example) has liquified. These phase transformation material retainers may comprise the same type of phase transformation material as the concentric phase transformation material rings 43, or another phase transformation material, but in either case may have a higher melting point than the phase transformation material rings 43. The standoff ring 64 prevents movement of the piston 48 until the phase transformation material of the standoff ring 64 has liquified. The holding button 66 prevents flow out of the nozzle(s) 46 until the phase transformation material of the holding button 66 has liquified. The higher melting point of the phase transformation material retainers helps ensure that the heater casing 56 is sufficiently heated and that the phase transformation material core is uniformly melted before the phase transformation material is discharged from the nozzles 46.

In one aspect, the process of heating the heater casing 56 to liquify the phase transformation material 42 and then urging the liquified phase transformation material out of the delivery chassis 40 may be initiated by a single step of applying and maintaining a pressure. A fluid inlet is provided along the annular chamber covered by a burstable fluid membrane so that upon sufficient pressure, the fluid membrane bursts to allow the flow of a fluid (e.g., water) into the annular chamber 44 to combine with the reactive powder 54. In the example configuration of FIG. 5 the fluid inlet comprises a narrow orifice 49 in the piston 48 and a burst disc 50 comprises the fluid membrane. A fluid pressure "P" may be applied external to the annular chamber to burst the burst disc 50 and allow the fluid to enter the annular chamber 44 through the orifice 49. The fluid then combines with the reactive powder 54 to initiate heating of the phase transformation material 42 within the heater casing 56 as described above. Once the phase transformation material 42 has melted, along with the optional phase transformation material retainers (standoff ring 144 and holding button 66), the same pressure "P" used initially to burst the burst disc 50 and initiate heating also advances the piston 48 to urge the liquified phase transformation material out of the nozzles 46.

Prior to initiating heating, which may be prior to deployment of the system 30 downhole, a vacuum may also initially be pulled in the chamber 44 between the squeeze piston 48 and the heater casing 56 via a vacuum port 118. The vacuum helps pull the contents of the annular chamber 44 (e.g., the phase transformation material rings 43, reactive powder 54) together and keep those contents under compression until the piston 48 has advanced from its position in FIG. 2 to when it is shouldered axially as shown in FIG. 3 or 4.

Various methods of liquifying and delivering a phase transformation material to seal an openhole interval may also be performed according to this disclosure. In one example method referencing the example apparatus of FIG.

5, an operator may initiate heating by applying fluid pressure inside of the delivery chassis 40 to burst a fluid membrane (e.g., burst disc 50). The bursting of the fluid membrane allows the fluid to enter the chamber 44 through the orifice 49 and mix with the reactive powder 54. The operator may maintain pressure as the contents of the annular chamber 44 heat. The fluid contacts the reactive powder 54, which starts an exothermic chemical reaction to produce the heat needed to melt the phase transformation material 42. The fluid that enters the chamber 44 may also serve as a heat transfer medium to convectionally heat the phase transformation material 42. During this reaction, a reaction byproduct (e.g., hydrogen) may be produced. The hydrogen or other such byproduct can be minimized by adding a scavenger to the reactive powder formulation. The remaining hydrogen will be allowed to bubble out of solution through the orifice 49 of the piston 48. As the heating continues, there may be no appreciable movement of the piston 48 or the contents of the chamber 44 until the appropriate heat is reached to fully melt through any phase transformation material retainers 64, 66. The retainers 64, 66 may axially lock the piston 48 so the piston 48 cannot begin to squeeze the phase transformation material out of the nozzles 46 until they fully melt through. Once a high enough temperature is reached at the top and bottom end of the heater casing 56, as a second surety that the alloy is fully melted through its length and is now allowed to be deployed, the standoff ring 64 and holding button 66, which are configured to melt at a higher temperature, melt, and allow the phase transformation material to be discharged out of the nozzles 46.

In an optional configuration, the squeeze piston 48 is made from a ferromagnetic material. Between the piston 48 and the phase transformation material 42 to be melted is the standoff ring 64 and a magnetic ring 70 made from a highly magnetic material such as neodymium. When the standoff ring 64 melts, the magnetic ring 70 is automatically attracted to the squeeze piston 48 and closes the orifice 49 in the piston 48 by creating a face seal, and uses magnetic force to provide the contact force. The piston 48 now operates as it would if the orifice 49 were not there (because the orifice is sealed), and the piston area through the orifice 49 is small enough not to pump away the magnetic ring 70.

While multiple events need to happen to allow the liquid seal to be deployed, the features of a design such as FIG. 5 are configured in such a way that the operator only needs to perform one step, build and maintain pressure for a fixed period of time.

Figure 6:
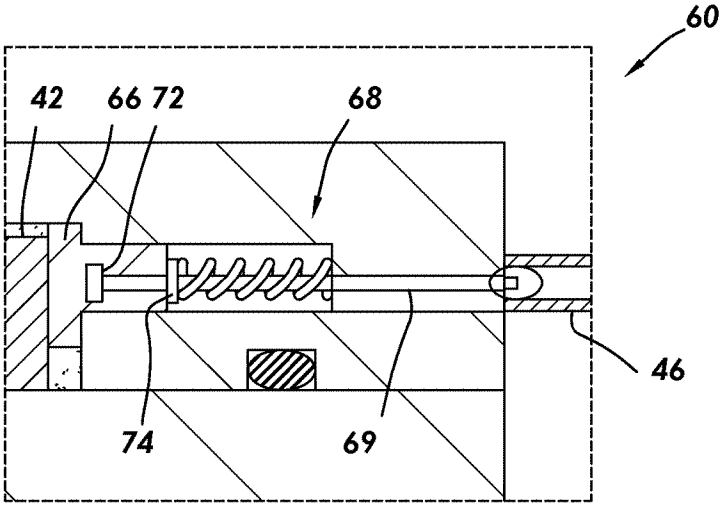
FIG. 6 is an enlarged view of the nozzle end of the delivery chassis of FIG. 5, further detailing the cooperation of the holding button and a check valve to control delivery of liquified phase transformation material through the nozzles.

FIG. 6 is an enlarged view of the nozzle end 60 of the delivery chassis 40 of FIG. 5, further detailing the cooperation of the holding button 66 and a check valve 68 to control delivery of liquified phase transformation material through the nozzles 46. The check valve 68 includes a valve body (e.g. schematically illustrated as a poppet) 69 and a valve head 72 encapsulated in the phase transformation material of the holding button 66. The holding button 66, while still in solid form, holds the valve head 72 away from a valve seat 74, but also plugs the opening to the valve seat 74 to prevent the discharge of any melted phase transformation material 42 of the core rings 43 through the nozzles 46. As the operator continues to maintain fluid pressure, and provided the holding button 66 and any other phase transformation material retainers have melted, the piston 48 (FIG. 5) may squeeze the phase transformation material 42 (and phase transformation material of the holding button 66 and other phase transformation material retainer(s) out of the nozzles 46 via the check valve(s) 68. After the phase transformation material of the holding button 66 melts, the pressure P may urge the valve 69 to an open condition.

Having detailed example configurations of the delivery chassis 40 of FIG. 5, FIGS. 7-9 now detail example configurations of the deployment chassis 100. The deployment chassis 100 cooperates with the delivery chassis 40 to receive the liquified phase transformation material delivered by the delivery chassis 40 and deploy the liquified phase transformation material outwardly to seal the openhole interval.

Figure 7:
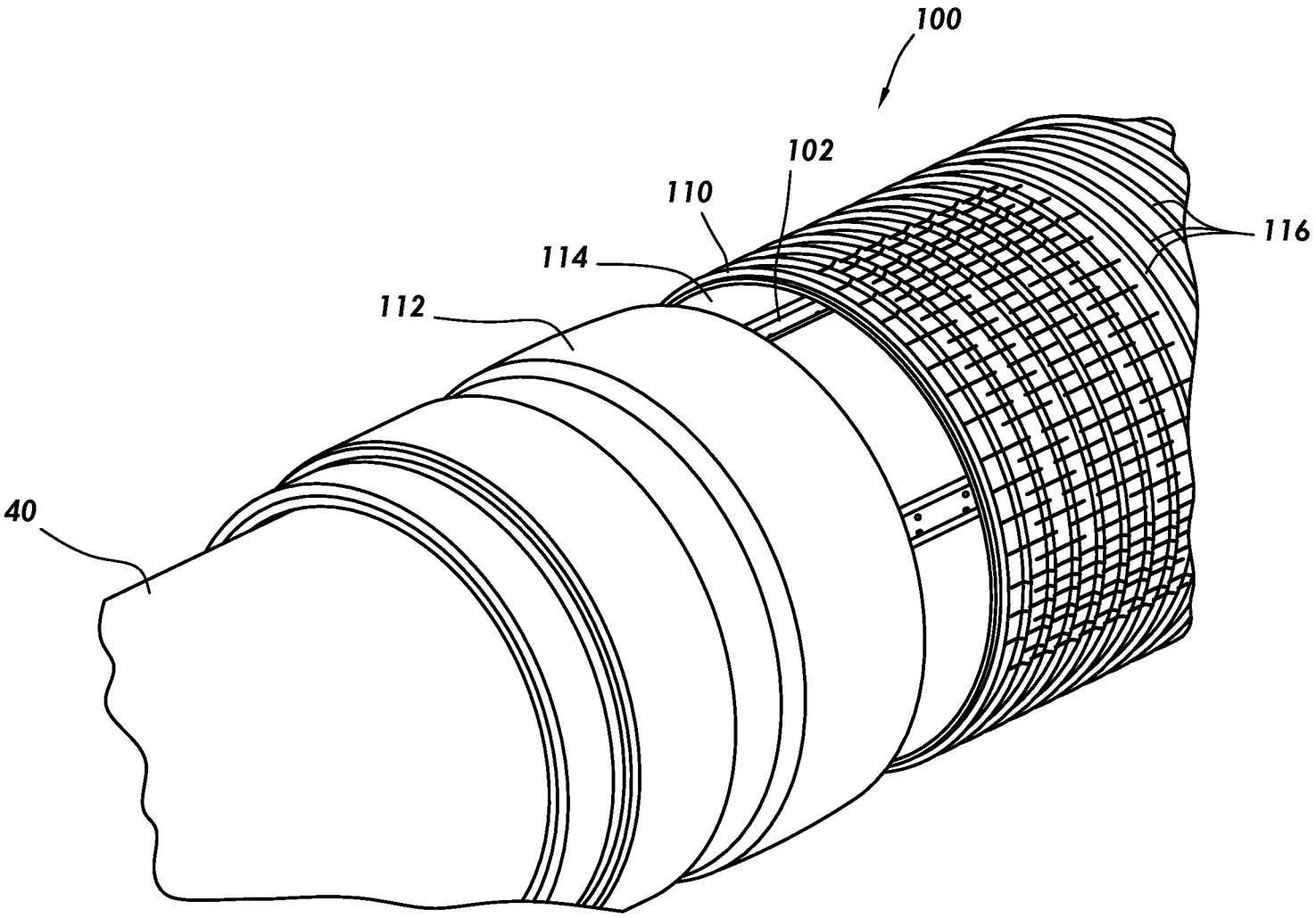
FIG. 7 is a perspective view of the deployment chassis as coupled to a body of the delivery chassis.

FIG. 7 is a perspective view of the deployment chassis 100 as coupled to a body of the delivery chassis 40. The deployment chassis 100 includes a cup packer 112, optional inflatable shunts 114, and the slip jacket 110. These components may each be supported directly or indirectly on the mandrel 104 (FIGS. 2-4). The cup packer 112 and slip jacket 110 are axially spaced from one another, revealing just a portion of the inflatable shunt(s) 114 that extend axially underneath the extent of the slip jacket 110. The inflatable shunts 114 are inflatable, such as in response to delivery of a pressurized fluid (which may be a different hydraulic pressure supply than the pressurized fluid used to initiate the reaction and distribute liquified phase transformation material). The shunts 114 may be inflated with sufficient pressure to radially expand the slip jacket 110 outwardly into or toward radial engagement with the wellbore, as explained above. The cup packer 112 may also be deployed and reinforced by the inflatable shunts 114. The cup packer(s) at either end help with containing the melted phase transformation material at the top and bottom of the assembly.

The liquified phase transformation material delivered through the nozzles of the delivery chassis 40 may be flowed along the conduits 102 of the deployment chassis 100, with the conduits 102 running along the length of and interior to the slip jacket 110. The slip jacket 110 comprises a plurality of perforations 116, which in this example are slot-shaped. The liquified phase transformation material flowing interior to the slip jacket 110 may also flow outwardly through the perforations 116 to fill the volume between the deployment chassis 100 and the openhole wellbore interval to be sealed. In one approach, the slip jacket 110 may first be expanded by the shunts 114 before flowing the liquified phase transformation material through the slip jacket 110 and out through the perforations 116. In yet another approach, the slip jacket 110 may be expanded simultaneously with the flow of the liquified phase transformation material. In any of these approaches, the inflation of the shunts 114 helps deploy the slip jacket 110 and cup containment system (e.g., cup packer 112) to the wellbore. The inflation also significantly reduces the annular volume to be packed by the melted phase transformation material to keep things shorter and easier to deploy.

The conduits 102 may contain multiple holes (not shown) appropriately spaced apart across the length. The surface area of the holes in the conduits 102 and the perforations 116 in the slip jacket 110 are sized and positioned such that the least torturous path for alloy is to fill through the axial length of the nozzle entirely before squeezing out of the perpendicular holes. That is, the holes and the perforations 116 are sized and positioned such that the liquified phase transformation material flows along an axial length of the interior flowpath of the slip jacket 110 prior to flowing outwardly through the perforations 116.

Figure 8:
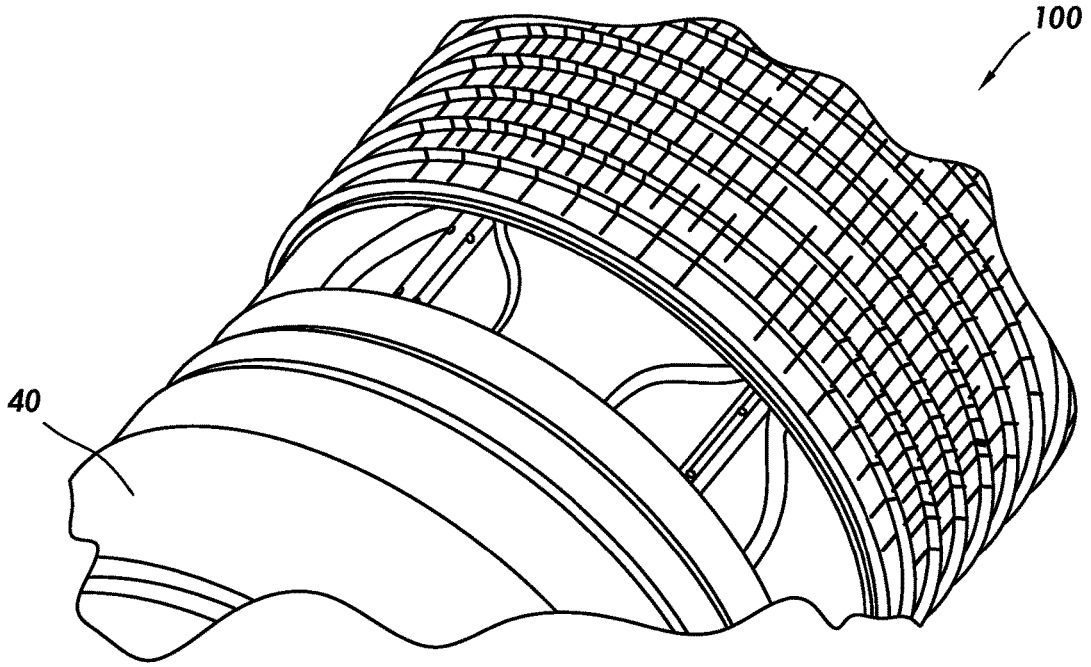
FIG. 8 is another perspective view of the deployment chassis as coupled to a body of the delivery chassis, with the cup packer of FIG. 7 suppressed.

FIG. 8 is another perspective view of the deployment chassis 100 as coupled to a body of the delivery chassis 40, but with the cup packer suppressed (collapsed) until it is desired to be released. That is, the cup packer is in an unset configuration to be later actuated by expanding the shunts.

Figure 9:
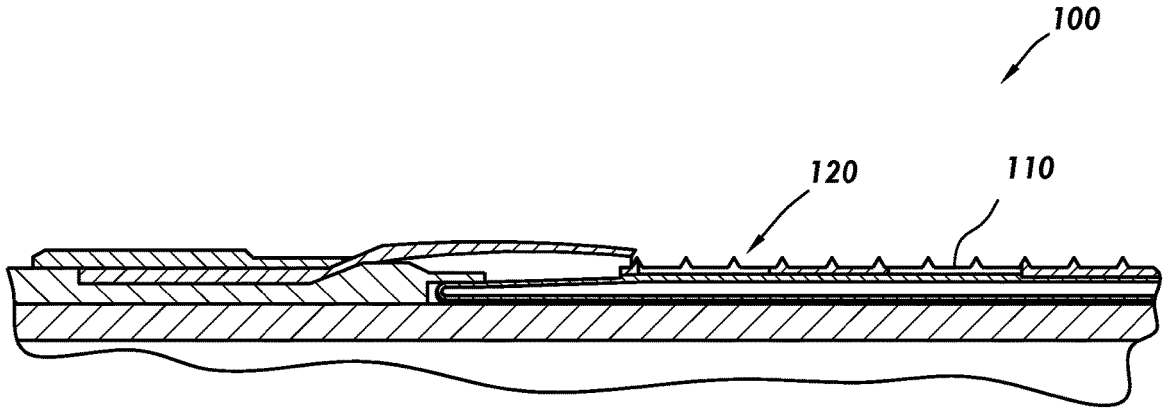
FIG. 9 is a side view of the deployment chassis illustrating an optional slip-teeth profile of the slip jacket.

FIG. 9 is a side view of the deployment chassis 100 illustrating an optional slip-teeth profile 120 of the slip jacket 110. The slip-teeth profile 120 helps anchor the tool to the wellbore to withstand contraction and expansion of tubing.

Accordingly, the present disclosure may provide systems, methods, compositions, and tools that create a reliable packoff in the openhole interval of a well using a phase transformation material to deploy into the open hole interval in liquid state and allowed to harden over specific conditions. Use of a liquid deployed seal allows us to achieve significantly high expansion ratios for the packer, without sacrificing differential pressure at max borehole ID, simply by increasing the length of the liquid-deployed seal container for more volume. The systems, methods, compositions, and tools may include any of the various features disclosed herein, including one or more of the following statements.

Statement 1. A system for sealing an openhole interval of a well, comprising: a delivery chassis having a solid phase transformation material (PTM) and a reactive material disposed along an annular chamber, one or more nozzles at one end of the annular chamber, a fluid inlet for introducing fluid into the chamber to exothermically combine with the reactive material to liquify the PTM, and a piston at an opposite end of the annular chamber for urging the liquified PTM out the one or more nozzles; and a deployment chassis in fluid communication with the one or more nozzles of the delivery chassis, for distributing the liquified PTM from the deployment chassis to the openhole interval of the well.

Statement 2. The system of statement 1, wherein the deployment chassis comprises a perforated sleeve extending along the openhole interval to be sealed, wherein the one or more nozzles of the delivery chassis are in fluid communication with an interior of the perforated sleeve.

Statement 3. The system of statement 2, wherein the one or more nozzles comprise a plurality of nozzles circumferentially spaced around the interior of the perforated sleeve.

Statement 4. The system of statement 2, wherein the deployment chassis further comprises one or more shunts oriented along the interior of the perforated sleeve, the one or more shunts inflatable for radially expanding the perforated sleeve along the openhole interval prior to a re-solidification of the liquified PTM.

Statement 5. The system of statement 2 or 3, further comprising an interior flowpath along the sleeve and a plurality of perforations along the perforated sleeve to the interior flowpath, the perforations sized and positioned such that the liquified PTM flows along an axial length of the interior flowpath prior to flowing outwardly through the perforations.

Statement 6. The system of any of statements 1-5, wherein the phase transformation material comprises a melting point of less than 300° C., the fluid comprises water, or the reactive material comprises an alkaline metal or its salts.

Statement 7. The system of any of statements 1-6, wherein the solid PTM comprises a PTM core and a PTM retainer at either end of the annular chamber for preventing the urging of the liquified PTM out the one or more nozzles until the PTM retainer has liquified, the PTM retainer having a higher melting point than the PTM core.

Statement 8. The system of statement 7, wherein the PTM retainer comprises a PTM standoff ring disposed between the piston and the PTM core that limits movement of the piston until the PTM standoff ring has liquified.

Statement 9. The system of statement 7 or 8, wherein the PTM retainer comprises a PTM holding button disposed between the PTM core and the one or more nozzles to prevent the flow of the PTM core until the PTM holding button has liquified.

Statement 10. The system of statement 9, further comprising a valve for controlling flow to the one or more nozzles, wherein the PTM holding button prevents the opening of the valve until the PTM holding button has liquified.

Statement 11. The system of any of statements 7-10, wherein the PTM core comprises a plurality of concentric rings disposed along the annular chamber.

Statement 12. The system of statement 1-11, further comprising: a membrane initially closing the fluid inlet from the fluid; and a pressure source configured for bursting the membrane to introduce the fluid into the chamber and for subsequently advancing the piston to urge the liquified PTM out the one or more nozzles.

Statement 13. A method for sealing an openhole interval of a well, comprising: exothermically combining a fluid with a reactive material in thermal contact with a phase transformation material (PTM) in an annular chamber to liquify the PTM; urging the liquified PTM into an annular space between a mandrel and the openhole interval of the well; and re-solidifying the PTM to seal between the mandrel and the openhole interval.

Statement 14. The method of statement 13, further comprising: positioning a perforated sleeve between the mandrel and the openhole interval; and flowing the liquified PTM between the mandrel and the perforated sleeve and out through perforations in the perforated sleeve.

Statement 15. The method of statement 13 or 14, further comprising: inflating one or more inflatable shunts between the mandrel and the perforated sleeve to expand the perforated sleeve toward the openhole interval prior to re-solidifying the PTM.

Statement 16. The method of any of statements 13-15, wherein flowing the liquified PTM between the mandrel and the perforated sleeve comprises flowing the liquified PTM along channels of the one or more inflatable shunts.

Statement 17. The method of statement 13, further comprising: initially blocking flow of the fluid into the annular chamber with a burst disc; and applying pressure to burst the membrane to introduce the fluid into the annular chamber and to advance a piston in the annular chamber to urge the liquified PTM into the annular space between the mandrel and the openhole interval of the well.

Statement 18. The method of statement 17, further comprising: initially preventing movement of the piston with a PTM retainer having a higher melting point than the PTM in thermal contact with the reactive material to first liquify the other of the PTM; and allowing the piston to advance once the PTM retainer has liquified.

Statement 19. A delivery chassis for sealing an openhole interval of a well, comprising: a heater casing defining an annular chamber; a solid phase transformation material (PTM) and a reactive powder disposed along the annular chamber; a fluid inlet for introducing fluid into the chamber to exothermically combine with the reactive powder to liquify the PTM; a nozzle at one end of the heater casing in fluid communication with the annular chamber; and a piston at an opposite end of the annular chamber for urging the liquified PTM out the nozzle.

Statement 20. The delivery chassis of statement 19, further comprising: a burst disc initially closing the fluid inlet from the fluid; and a pressure source for bursting the burst disc to introduce the fluid into the chamber and advance the piston for urging the liquified PTM out the nozzle.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A system for sealing an openhole interval of a well, comprising:

a delivery chassis having a solid phase transformation material (PTM) and a reactive material disposed along an annular chamber, one or more nozzles at one end of the annular chamber, a fluid inlet for introducing fluid into the chamber to exothermically combine with the reactive material to liquify the PTM, and a piston at an opposite end of the annular chamber for urging the liquified PTM out the one or more nozzles; and a deployment chassis in fluid communication with the one or more nozzles of the delivery chassis, for distributing the liquified PTM from the deployment chassis to the openhole interval of the well.

2. The system of claim 1, wherein the deployment chassis comprises a perforated sleeve extending along the openhole interval to be sealed, wherein the one or more nozzles of the delivery chassis are in fluid communication with an interior of the perforated sleeve.

3. The system of claim 2, wherein the one or more nozzles comprise a plurality of nozzles circumferentially spaced around the interior of the perforated sleeve.

4. The system of claim 2, wherein the deployment chassis further comprises one or more shunts oriented along the interior of the perforated sleeve, the one or more shunts inflatable for radially expanding the perforated sleeve along the openhole interval prior to a re-solidification of the liquified PTM.

5. The system of claim 2, further comprising an interior flowpath along the sleeve and a plurality of perforations along the perforated sleeve to the interior flowpath, the perforations sized and positioned such that the liquified PTM flows along an axial length of the interior flowpath prior to flowing outwardly through the perforations.

6. The system of claim 1, wherein the phase transformation material comprises a melting point of less than 300° C., the fluid comprises water, or the reactive material comprises an alkaline metal or its salts.

7. The system of claim 1, wherein the solid PTM comprises a PTM core and a PTM retainer at either end of the annular chamber for preventing the urging of the liquified PTM out the one or more nozzles until the PTM retainer has liquified, the PTM retainer having a higher melting point than the PTM core.

8. The system of claim 7, wherein the PTM retainer comprises a PTM standoff ring disposed between the piston and the PTM core that limits movement of the piston until the PTM standoff ring has liquified.

9. The system of claim 7, wherein the PTM retainer comprises a PTM holding button disposed between the PTM core and the one or more nozzles to prevent the flow of the PTM core until the PTM holding button has liquified.

10. The system of claim 9, further comprising a valve for controlling flow to the one or more nozzles, wherein the PTM holding button prevents the opening of the valve until the PTM holding button has liquified.

11. The system of claim 7, wherein the PTM core comprises a plurality of concentric rings disposed along the annular chamber.

12. The system of claim 1, further comprising:

a membrane initially closing the fluid inlet from the fluid; and a pressure source configured for bursting the membrane to introduce the fluid into the chamber and for subsequently advancing the piston to urge the liquified PTM out the one or more nozzles.

13. A method for sealing an openhole interval of a well, comprising:

exothermically combining a fluid with a reactive material in thermal contact with a phase transformation material (PTM) in an annular chamber to liquify the PTM;

positioning a perforated sleeve between the mandrel and the openhole interval;

flowing the liquified PTM between the mandrel and the perforated sleeve and out through perforations in the perforated sleeve;

urging the liquified PTM into an annular space between the mandrel and the openhole interval of the well;

re-solidifying the PTM to seal between the mandrel and the openhole interval; and inflating one or more inflatable shunts between the mandrel and the perforated sleeve to expand the perforated sleeve toward the openhole interval prior to re-solidifying the PTM.

14. The method of claim 13, wherein flowing the liquified PTM between the mandrel and the perforated sleeve comprises flowing the liquified PTM along channels of the one or more inflatable shunts.

15. A method for sealing an openhole interval of a well, comprising:

exothermically combining a fluid with a reactive material in thermal contact with a phase transformation material (PTM) in an annular chamber to liquify the PTM;

initially blocking flow of the fluid into the annular chamber with a burst disc;

applying pressure to burst the burst disc to introduce the fluid into the annular chamber and to advance a piston in the annular chamber to urge the liquified PTM into an annular space between the mandrel and the openhole interval of the well; and re-solidifying the PTM to seal between the mandrel and the openhole interval.

16. The method of claim 15, further comprising:

initially preventing movement of the piston with a PTM retainer having a higher melting point than the PTM in thermal contact with the reactive material to first liquify the PTM; and allowing the piston to advance once the PTM retainer has liquified.

17. The method of claim 15, further comprising:

positioning a perforated sleeve between the mandrel and the openhole interval; and flowing the liquified PTM between the mandrel and the perforated sleeve and out through perforations in the perforated sleeve.

18. A delivery chassis for sealing an openhole interval of a well, comprising:

a heater casing defining an annular chamber;

a solid phase transformation material (PTM) and a reactive powder disposed along the annular chamber;

a fluid inlet for introducing fluid into the chamber to exothermically combine with the reactive powder to liquify the PTM;

a nozzle at one end of the heater casing in fluid communication with the annular chamber; and a piston at an opposite end of the annular chamber for urging the liquified PTM out the nozzle.

19. The delivery chassis of claim 18, further comprising:

a burst disc initially closing the fluid inlet from the fluid; and a pressure source for bursting the burst disc to introduce the fluid into the chamber and advance the piston for urging the liquified PTM out the nozzle.

* * * * *